US008177402B2

(12) United States Patent
Ackermann et al.

(10) Patent No.: US 8,177,402 B2
(45) Date of Patent: May 15, 2012

(54) LIGHT MODULE FOR AN ILLUMINATION DEVICE FOR A MOTOR VEHICLE

(75) Inventors: Ralf Ackermann, Kirchentellinsfurt (DE); Ernst-Olaf Rosenhahn, Bodelshausen (DE)

(73) Assignee: Automotive Lighting Reutlingen GmbH (DE)

( * ) Notice: Subject to any disclaimer, the term of this patent is extended or adjusted under 35 U.S.C. 154(b) by 327 days.

(21) Appl. No.: 12/503,346

(22) Filed: Jul. 15, 2009

(65) Prior Publication Data

US 2010/0027284 A1 Feb. 4, 2010

(30) Foreign Application Priority Data

Aug. 2, 2008 (DE) ..... 10 2008 036 194

(51) Int. Cl.
*F21V 7/00* (2006.01)

(52) U.S. Cl. ..... 362/517; 362/543; 362/545

(58) Field of Classification Search ..... 362/516, 362/517, 518, 543, 545, 546, 547
See application file for complete search history.

(56) References Cited

U.S. PATENT DOCUMENTS 7,178,960 B2 * 2/2007 Ishida ..... 362/545
7,686,488 B2 * 3/2010 Inoue et al. ..... 362/509
7,794,128 B2 * 9/2010 Fujiwara et al. ..... 362/545
2007/0035957 A1 * 2/2007 Albou et al. ..... 362/487
2009/0231876 A1 * 9/2009 Nakamura et al. ..... 362/545

* cited by examiner

*Primary Examiner* — John A Ward
(74) *Attorney, Agent, or Firm* — Donald R. Boys; Central Coast Patent Agency, Inc.

(57) ABSTRACT

The invention relates to a light module (1) for an illumination device (20), in particular for a headlight, for a motor vehicle. The light module (1) comprises a plurality of light sources (2) for emitting light beams (4, 5), at least one primary optical unit (6; 12) for focusing the emitted light beams (4*a*, 5*a*), a stop arrangement (8) in the beam path of the focused light beams (4*b*, 5*b*), and at least one secondary optical unit (9) for imaging the focused light beams (4*b*, 5*b*) which passed the stop arrangement (8) on a roadway in front of the motor vehicle in order to generate a desired light distribution. In order to be able to implement a particularly compact illumination device (20), in particular with a particularly low installation height, in which moreover the exhaust heat generated by the light sources (2) during operation can escape particularly well, it is proposed that the light module (1) has at least two laterally emitting light emitting diodes (2) as light sources and at least two laterally arranged half-bowl reflectors (6), assigned in each case to at least one of the light emitting diodes (2), as primary optical units.

28 Claims, 2 Drawing Sheets

LIGHT MODULE FOR AN ILLUMINATION DEVICE FOR A MOTOR VEHICLE

CROSS-REFERENCE TO RELATED DOCUMENTS

The present application claims priority to German patent application serial number 10 2008 036 194.1, which was filed on Aug. 2, 2008, which is incorporated herein in its entirety, at least by reference.

The present invention relates to a light module for an illumination device, in particular for a headlight, of a motor vehicle. The light module comprises a plurality of light sources for emitting light beams, at least one primary optical unit for focusing the emitted light beams, a stop arrangement in the beam path of the focused light beams, and at least one secondary optical unit for imaging the focused light beams which passed the stop arrangement on a roadway in front of the motor vehicle in order to generate a desired light distribution. The invention furthermore relates to an illumination device of a motor vehicle, comprising a housing with a light emission opening sealed by a cover pane and, arranged in the housing, at least one light module for generating a desired light distribution on a roadway in front of the motor vehicle.

The prior art discloses LED (light emitting diode) modules for illumination devices, in particular for headlights, of motor vehicles with light emitting diodes aligned upward or downward, or in the direction of travel. Preferably, a number of light emitting diodes (LEDs) are attached to the top side, bottom side and front end face of a cooling body. The LEDs can be grouped, in the form of a matrix, in a number of rows and columns to form so-called LED arrays. The known LED modules only serve to generate a single light function (so-called monofunctionality) because current LED arrays cannot attain the luminous intensity required for multifunctionality. That is to say, a known LED module can either generate a dipped beam or a full beam or another light function, but it cannot generate a number of light functions (bi- or multifunction).

Additionally, the known LED modules have a relatively large installation size, in particular, they are relatively high, because the light emitting diodes are aligned upward or downward and suitable primary optical units, for example in the form of reflectors, have to be arranged above and below the light emitting diodes, respectively, in order to focus the light emitted by the light emitting diodes. It is customary for a cooling body to be arranged between the light emitting diodes emitting upward or downward in order to dissipate the heat generated by the operation of the light emitting diodes. The heat that is not dissipated by the cooling body rises in the LED module or in the illumination device and leads to relatively high temperatures in the upper region of the LED module or the illumination device. This can lead to a reduction in the service life of the components of the LED module, or even to a complete loss of functionality.

Using the described prior art as a starting point, the present invention is based on the object of implementing a light module having a design with a particularly low installation height and in which the heat generated during operation of the light sources can be dissipated particularly well.

In order to achieve this object, it is proposed, using the illumination device of the type mentioned initially, that the illumination device has at least two laterally emitting light emitting diodes as light sources and at least two laterally arranged half-bowl reflectors, assigned in each case to at least one of the light emitting diodes, as primary optical units.

Preferably, provision is made for a cooling body between the two laterally emitting light emitting diodes in order to dissipate the heat generated by the operation of the light emitting diodes. In each case, one or more light emitting diodes, e.g. grouped as LED arrays, can be provided on both sides of the illumination body. The lateral arrangement of the reflectors results in an LED module with a particularly low installation height or an illumination device with a particularly low installation height, which is particularly advantageous from the point of view of reducing the coefficient of air resistance (the so-called cw value) and hence the fuel consumption of a motor vehicle. Additionally, the low installation height results in the possibility of arranging, for example, an indicator lamp or a day-driving lamp above or below it.

That is to say, the invention implements an LED module, in which the LEDs emit laterally, and two laterally arranged half-bowl reflectors focus the emitted light. The focused light is projected through a secondary optical unit, for example in the form of a projection lens, in order to generate a desired light distribution on the roadway in front of the motor vehicle. If the light distribution has a light-dark boundary (for example, dipped beam, fog lights, etc.), a stop arrangement can be arranged in front of the secondary optical unit in the beam path of the focused light, the optically effective upper edge of which is projected onto the roadway as a light-dark boundary. In order to generate a variable or adaptive light distribution with a changeable profile of the light-dark boundary, the profile of the upper edge of the stop arrangement can be changeable.

The heat generated during the operation of the LEDs can rise and escape between the two laterally arranged half-bowl reflectors. This prevents the accumulation of heat in the light module. Alternatively, or additionally, it is also possible to use a ventilator in order to guide the ambient air through the cooling body ribs from behind or below. This can very effectively contribute to the dissipation of heat. For technical reasons, this makes it possible to attain a particularly high maximum luminous intensity. The reasons for this are, for example, the horizontally oriented light source or LED array images and the larger horizontal extent of the light distribution compared to the vertical extent. This enables the implementation of different light functions with the same LED module (so-called multifunctionality). This affords the possibility of, for example, implementing a bi-function as a combination of dipped beam and full beam by a moveable or hinged stop arrangement.

It is possible to vary the luminous intensity in the different light functions by dimming the light emitting diodes. In the process, the temperature distribution in the LED module or in the illumination device is also optimized. By way of example, in the dipped beam mode, the electricity flowing through the light emitting diodes can be reduced compared to the full beam mode, since the dipped beam requires a lower luminous intensity maximum than the full beam. The electricity can, for example, be changed by means of pulse width modulation.

Features and advantages, as well as further preferred refinements of the light module according to the invention are claimed in the dependent claims and are explained in more detail below with reference to the drawings, in which:

Figure 4:
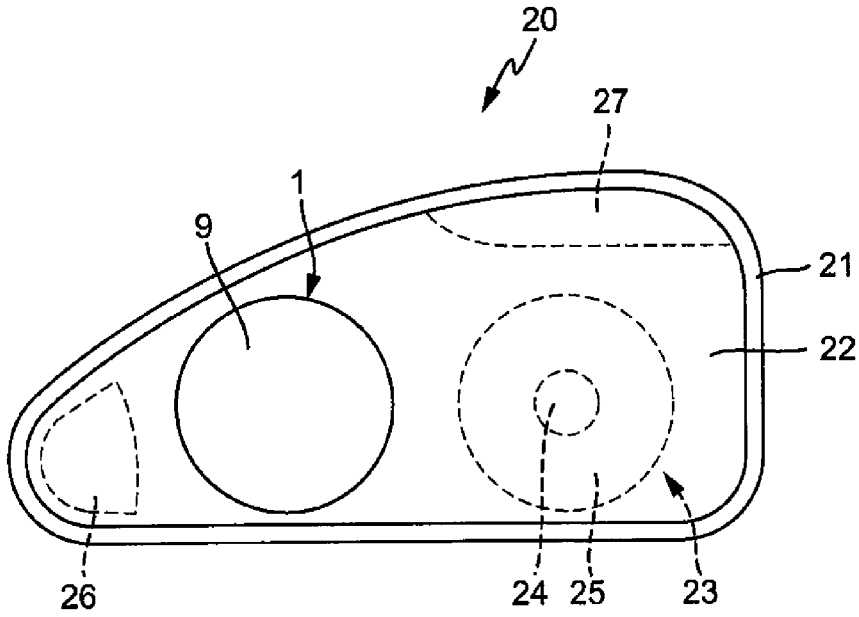
FIG. 4 shows a schematic view from the front against the light emission direction of an illumination device according to the invention in accordance with a preferred embodiment.

In FIG. 4, an illumination device according to the invention is, in its entirety, referred to by the reference symbol 20. It is designed as a headlight 20 for a motor vehicle. The headlight 20 comprises a housing 21 which is preferably composed of plastic and has, in a light emission direction, a light emission opening which is closed by means of a cover pane 22 which is transparent to light. The cover pane 22 can be designed with or without optically effective elements (such as prisms, cylindrical lenses, etc.). A light module 1 according to the invention is arranged in the housing 21 and is designed as a projection module; it will be explained in more detail below. Additionally, it is possible for one or more additional light modules, such as the light modules 23, 26 and 27, to be arranged in the housing 21 of the headlight 20. For example, the light module 23 is designed as a reflection system and is used, for example, to generate the fog light, dipped beam, full beam, part of the mentioned light functions or the like. The light module 23 comprises a light source 24 and a reflector 25 which are visible through the cover pane 22. The light module 26 can be designed as a static curve light module, which is activated when passing through curves and laterally illuminates the roadway toward the curve inner side. The light module 27 can be designed as an indicator light module or as a position and/or day-driving light module.

Figure 1:
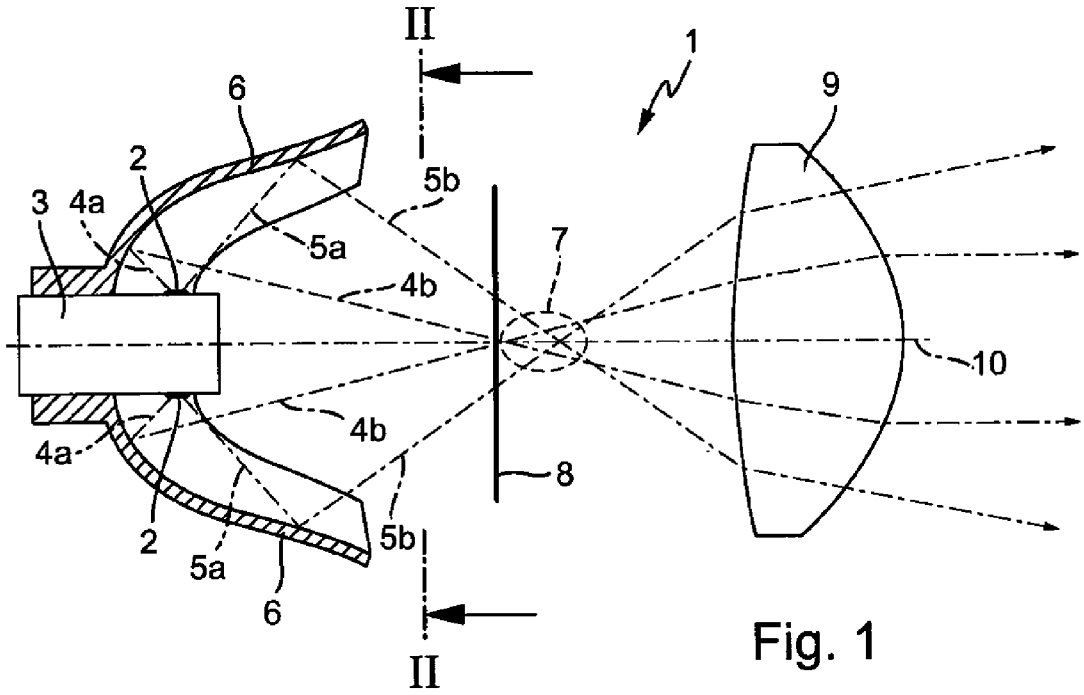
FIG. 1 shows a plan view of an LED module according to the invention in accordance with a preferred embodiment.

FIG. 1 illustrates the light module 1 according to the invention in detail. The light module 1 can be arranged either on its own or together with other light modules 23, 26 in the housing 21 of the illumination device 20. The light beams generated by the light module 1 pass through the light emission opening and out of the housing 21 of the illumination device 20.

FIG. 1 shows a view from the top onto the light module 1. It comprises a number of light emitting diodes (LEDs) 2 which are attached laterally to a cooling body 3. Instead of arranging only one LED 2 on each side of the cooling body 3, as illustrated in FIG. 1, it is also possible for a number of LEDs 2, in particular so-called LED arrays, to be arranged on the sides of the cooling body 3. The cooling body 3 serves to dissipate heat generated during the operation of the light emitting diodes 2. The light emitting diodes 2 emit light into their respectively assigned half-spaces. A main emission direction of the light emitting diodes 2 lies in or in the vicinity of a horizontal central plane, which passes through the optical axis 10 of the light module 1, and lies substantially perpendicular to the optical axis 10.

The beam path of the light is illustrated in FIG. 1 on the basis of two light beams 4, 5, selected in an exemplary manner. The light (light beams 4*a*, 5*a*) emitted by the light emitting diodes 2 into the half-space is incident on a reflection surface of a half-bowl reflector 6 which substantially encompasses the half-space and is arranged laterally on the cooling body 3. The half-bowl reflectors 6 preferably have a poly-elliptical form. The reflectors 6 focus the light emitted by the light emitting diodes 2 so that the reflected light beams 4*b*, 5*b* intersect in a focal point region 7. In the light emission direction, the focal point region 7 lies behind a stop arrangement 8 arranged in the beam path of the reflected light beams 4*b*, 5*b*. The light beams 4*b*, 5*b* which pass the stop arrangement 8 are imaged by a secondary optical unit, designed as a projection lens 9 in the illustrated exemplary embodiment, on a roadway in front of the motor vehicle for generating a desired light distribution.

The stop arrangement 8 has an upper edge, which is imaged by the projection lens 9 as an upper light-dark boundary of the light distribution projected onto the roadway. The stop arrangement 8 can be moved into or out of the beam path, for example in order to switch the light function generated by the light module 1 between the dipped beam and full beam. The stop arrangement 8 can have a number of stop elements (not illustrated) which each have their own upper edge. The optically effective upper edge of the stop arrangement 8 results from a superposition of the upper edges of the individual stop elements. Preferably, the various stop elements have differently designed upper edges. By changing the relative position of the upper edges of the stop elements with respect to one another, it is possible for the position and profile of the optically effective upper edge of the stop arrangement to be varied. Design and functioning of such a stop arrangement 8 are described in detail in DE 10 2005 012 303 A1. Reference is explicitly made to this document. Of course, the stop arrangement for generating different profiles of the light-dark boundary of the light distribution can also be shaped differently, for example designed in the form of a roller which can rotate about a rotational axis, which is substantially horizontal and transverse with respect to the optical axis 10, and on the outer circumferential surface of which roller different edge profiles are formed so that depending on the rotational angle of the roller, a certain upper edge profile is inserted into the beam path and is optically effective.

As mentioned previously, the half-bowl reflectors 6 have a surface shape which is similar to a general ellipsoid. However, the shape is determined or varied at a multiplicity of discrete points by means of a suitable computer program and details will deviate slightly from said shape. In the process, the coordinates of the points are determined point by point in three-dimensional space such that a light beam incident on the point is reflected or imaged at a desired location in the light distribution. Subsequently, an interpolation is performed between the calculated discrete points. As a result of the poly-elliptical shape of the half-bowl reflectors 6, the latter have two focal point regions, one of which being the focal point region 7 at which the reflected light beams 4*b*, 5*b* intersect. The focal point region 7 also lies in the vicinity of the focal plane of the projection lens 9. The light emitting diodes 2 are arranged in the other focal point region of the reflectors 6.

Figure 2:
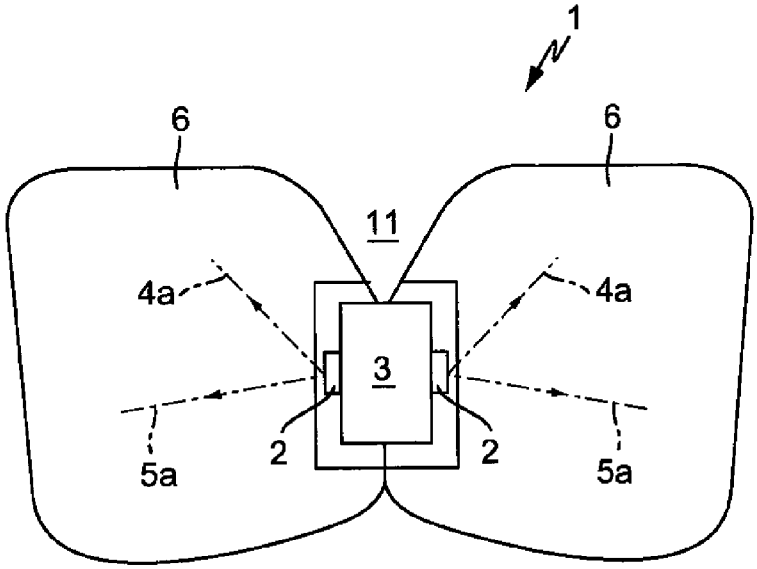
FIG. 2 shows a view of the LED module from FIG. 1 along the cut II-II from FIG. 1.

FIG. 2 shows a view of part of the light module 1 along the line II-II from FIG. 1 against the light emission direction. Here, the cooling body 3 with the laterally arranged LEDs 2 arranged in the region of the optical axis of the light module 1 can be seen particularly well. Furthermore, it is also conspicuous that the half-bowl reflectors 6 are also arranged to the side of the cooling body 3 so that the light module 1 of the illumination device according to the invention overall results in a significantly greater width than height. In particular, the illustrated light module 1 for an LED module is designed with a particularly low installation height.

A further advantage of the light module 1 can be considered to be the fact that a ventilation opening is provided in an upper region of the light module 1, in a region 11 between the two half-bowl reflectors 6 and substantially in a vertical central plane, in order to allow warm air generated by the operation of the light emitting diodes 2 to escape upward. In the illustrated exemplary embodiment, the ventilation opening is simply formed by a distance between the two half-bowl reflectors 6 in the region 11. Of course, it would also be feasible for the half-bowl reflectors 6 to also adjoin each other in the region 11 and there being one or more ventilation openings in the form of holes or slits in one or both reflectors 6 in the region 11. This prevents accumulation of heat in the LED module 1 because the heat generated by the operation of the LEDs 2 can escape upward almost unimpeded. Accordingly, this affords the possibility of the cooling body 3 also having smaller dimensions, as a result of which space and weight can be saved. Alternatively, it is also possible to use more or more powerful LEDs 2 in the LED module 1 because the exhaust heat produced additionally as a result of the higher power can escape upward without problems. An opening on the under side of the cooling body 3 is also advantageous in this principle of convective cooling.

An advantage of the light emitting diodes 2, used in the LED modules 1 of the illumination device according to the invention, as light sources is the fact that the components of the LED modules 1 can be produced from materials which are inherently stable for only relatively low temperatures. This is due to the radiation emitted by the light emitting diodes 2, which has hardly any or even no infra-red component and as a result of this does not heat the components of the LED module 1, for example the stop arrangement 8, as much as would be the case in halogen lamps or gas discharge lamps.

Figure 3:
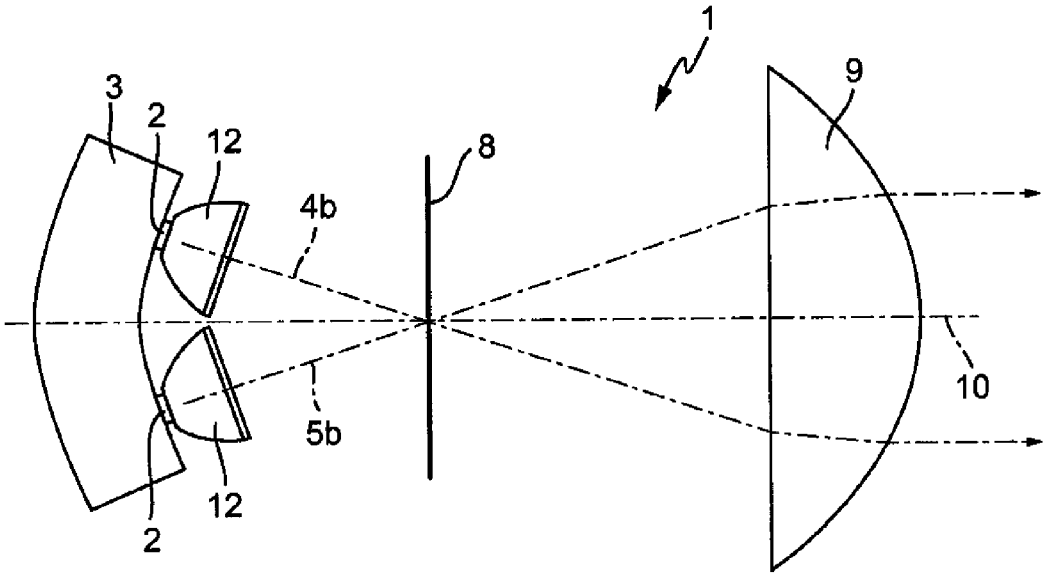
FIG. 3 shows an LED module in accordance with another preferred embodiment.

FIG. 3 shows a further possibility of a refinement of the LED module 1 which, however, does not fall into the scope of protection of the claims. The exemplary embodiment from FIG. 3 differs from the exemplary embodiment illustrated in FIG. 1 by virtue of the fact that the primary optical units are not designed as half-bowl reflectors 6, but as supplementary optical units 12. The light emitted by the light emitting diodes 2 is coupled into the supplementary optical units 12 via a light coupling-in surface of the latter facing the light emitting diodes 2. There, the coupled-in light is focused according to the principle of total internal reflection and finally emerges from the supplementary optical units 12 through a light decoupling surface of the latter facing away from the light emitting diodes 2.

The invention claimed is:

1. Light module for an illumination device, in particular for a headlight, of a motor vehicle, said light module comprising:

a plurality of light sources for emitting light beams, at least one primary optical unit for focusing the emitted light beams, a stop arrangement in the beam path of the focused light beams, at least one secondary optical unit for imaging the focused light beams which passed the stop arrangement on a roadway in front of the motor vehicle in order to generate a desired light distribution, and at least two laterally emitting half-bowl reflector modules, in which each of the half-bowl reflector modules comprises at least one light emitting diode as a light source and at least one laterally arranged half-bowl reflector, assigned in each case to at least one of the light emitting diodes, as a primary optical unit.

2. Light module according to claim 1, wherein the light emitting diodes are arranged such that a main emission direction of the light emitting diodes lies in or in the vicinity of a horizontal central plane, which has an optical axis of the light module, and extends substantially perpendicularly to the optical axis of the light module.

3. Light module according to claim 2, wherein the light module has a cooling body arranged between the laterally emitting light emitting diodes.

4. Light module according to claim 3, wherein the cooling body is arranged in an optical axis of the light module.

5. Light module according to claim 1, wherein the half-bowl reflectors have a poly-elliptical free form.

6. Light module according to claim 1, wherein the light module has a projection lens as a secondary optical unit.

7. Light module according to claim 5, wherein a focal point region of the poly-elliptical half-bowl reflectors is arranged in the vicinity of a focal plane of the projection lens.

8. Light module according to claim 1, wherein the stop arrangement has an optically effective upper edge with a variable profile which is imaged by the secondary optical unit as an upper light-dark boundary of the light distribution on the roadway in front of the motor vehicle.

9. Light module according to claim 1, wherein electricity flowing through the light emitting diodes can be adjusted as a function of the desired light distribution.

10. Light module according to claim 9, wherein the electricity can be adjusted individually for one or more of the light emitting diodes.

11. Light module according to claim 1, wherein at least one ventilation opening is provided in an upper half-space of the light module, in a region between the two half-bowl reflectors, in order to allow heat generated by the operation of the light emitting diodes to escape upward.

12. Light module according to claim 11, wherein the at least one ventilation opening is formed at least in the vicinity of a vertical central plane of the light module.

13. Light module according to claim 1, wherein the half-bowl reflectors generate at least substantially similar components of the desired light distribution.

14. Light module according to claim 13, wherein the light distribution components extend substantially horizontally and overlap in the center of the desired light distribution to form a maximum.

15. Light module according to claim 1, wherein each of the light sources of the half-bowl reflector modules comprise a plurality of light emitting diode chips which are arranged in one or more matrix rows.

16. Light module according to claim 15, wherein the light emitting diode chips, arranged in the matrix rows, of the individual half-bowl reflector modules extend at least substantially along an optical axis of the half-bowl reflector module and at least substantially along the optical axis of the light module.

17. Light module according to claim 15, wherein the light emitting diode chips, arranged in the matrix rows, of the individual half-bowl reflector modules extend at least substantially across the optical axis of the light module.

18. Light module according to claim 17, wherein the half-bowl reflector modules of the light module have different designs regarding the number and/or arrangement of the light emitting diodes, or light emitting diode chips, and/or regarding the alignment of the optical module axes.

19. Light module according to claim 18, wherein the light emitting diode chips, arranged in the matrix rows, of one of the half-bowl reflector modules are aligned at least substantially along the optical axis of the light module and the light emitting diode chips, arranged in the matrix rows, of another half-bowl reflector module are aligned at least substantially across the optical axis of the light module.

20. Light module according to claim 17, wherein the individual light emitting diodes, or the individual light emitting diode chips, for generating radiation of different brightness, color and/or wavelength can be actuated independently of one another.

21. Light module according to claim 1, wherein the half-bowl reflector modules are designed such that they can be moved relative to one another in the vertical and/or horizontal direction in order to vary the desired light distribution.

22. Light module according to claim 21, wherein the cooling body has a multipart design, with at least part of the cooling body being able to move with at least one of the half-bowl reflector modules relative to another part of the cooling body.

23. Light module according to claim 22, wherein the cooling body has cooling ribs, with the ribs of the different parts of the cooling body being intermeshed relative to one another at least in part in at least one movement position of the cooling body parts.

24. Light module according to claim 2, wherein at least one further half-bowl reflector module is arranged above and/or below the horizontal central plane of the light module, the at least one further half-bowl reflector module comprising at least one light emitting diode as a light source and at least one primary optical unit assigned to the at least one light emitting diode for focusing the light beams emitted by the light source.

25. Light module according to claim 1, wherein the reflection surface of the at least one half-bowl reflector is designed as a totally reflecting outer surface of an optical waveguide block.

26. Light module according to claim 1, wherein at least one of the half-bowl reflector modules comprises further light emitting diodes in addition to the light emitting diodes in the vicinity of the focal point, which are arranged around the light emitting diodes in the vicinity of the focal point which are always activated during operation of the motor vehicle for generating a first light distribution, and said further light emitting diodes can be activated additionally in order to generate a second light distribution which differs from the first light distribution.

27. Illumination device of a motor vehicle, the illumination device comprising a housing with a light emission opening sealed by a cover pane and, arranged in the housing, at least one light module for generating a desired light distribution on a roadway in front of the motor vehicle, in which at least one of the light modules is designed as a light module according to claim 1.

28. Illumination device according to claim 27, wherein the illumination device is designed as a motor vehicle headlight.

* * * * *